US007397430B2

(12) United States Patent
Harihara

(10) Patent No.: US 7,397,430 B2
(45) Date of Patent: Jul. 8, 2008

(54) SURFACE MOUNTED ANTENNA AND RADIO EQUIPMENT USING THE SAME

(75) Inventor: Yasumasa Harihara, Tokyo (JP)

(73) Assignee: TDK Corporation, Tokyo (JP)

( * ) Notice: Subject to any disclaimer, the term of this patent is extended or adjusted under 35 U.S.C. 154(b) by 150 days.

(21) Appl. No.: 11/190,906

(22) Filed: Jul. 28, 2005

(65) Prior Publication Data

US 2006/0044191 A1 Mar. 2, 2006

(30) Foreign Application Priority Data

Aug. 5, 2004 (JP) ..... 2004-229752

(51) Int. Cl.
*H01Q 1/38* (2006.01)

(52) U.S. Cl. ..... 343/700 MS; 343/846

(58) Field of Classification Search ..... 343/700 MS, 343/702, 846

See application file for complete search history.

(56) References Cited

U.S. PATENT DOCUMENTS 5,434,579 A * 7/1995 Kagoshima et al. ... 343/700 MS
6,040,806 A * 3/2000 Kushihi et al. ..... 343/853
6,067,461 A * 5/2000 Ye et al. ..... 505/210
6,140,968 A * 10/2000 Kawahata et al. ..... 343/700 MS
6,812,894 B2 * 11/2004 Shibata et al. ..... 343/700 MS

FOREIGN PATENT DOCUMENTS

JP 11-074721 3/1999
JP 2003-289219 10/2003

* cited by examiner

*Primary Examiner*—Michael C Wimer
(74) *Attorney, Agent, or Firm*—Wolff Law Offices PLLC; Kevin Alan Wolff

(57) ABSTRACT

A surface mounted antenna according to the present invention includes a dielectric block 11, a radiating electrode 12 formed on one of a main surface 11*a* of the dielectric block 11, a ground electrode 13 formed on the other main surface 11*b* of the dielectric block 11, and a feed electrode 14 formed on a side surface 11*c* of the dielectric block 11 and electromagnetically coupled with the radiating electrode 12. In the present invention, since the feed electrode 14 is formed on the side surface 11*c* of the dielectric block 11, the size of the main surface 11*a* of the dielectric block 11 can be made smaller than that of the conventional dielectric block. Accordingly, since further miniaturization can be realized, when the dielectric block 11 is mounted on a printed circuit board or the like, the mounting area can be reduced as compared with the conventional dielectric block.

25 Claims, 11 Drawing Sheets

SURFACE MOUNTED ANTENNA AND RADIO EQUIPMENT USING THE SAME

TECHNICAL FIELD

The present invention relates to a surface mounted antenna and a radio equipment using the same, and more particularly, relates to a surface mounted antenna that can be miniaturized and a radio equipment using the same.

BACKGROUND OF THE INVENTION

As an antenna used for a radio equipment, a patch antenna is most common, which includes a dielectric block, a radiating electrode formed on one main surface thereof, a ground electrode formed on the other main surface of a dielectric block, and a feed pin arranged so as to penetrate the dielectric block from the one main surface to the other main surface, as disclosed in Japanese Patent Application Laid-Open No. 2003-289219.

In the antenna disclosed in Japanese Patent Application Laid-Open No. 2003-289219, however, since it has such a configuration that power is fed to the radiating electrode by the feed pin penetrating the dielectric block, not only surface mounting to a printed circuit board or the like is difficult, but also the feed pin and a member such as a double-sided tape for fixation are necessary, thereby causing a problem in that the number of parts increases. Further, since a soldering step is required for fixing the feed pin, the production cost also increases.

As a method for solving these problems, Japanese Patent Application Laid-Open No. H11-74721 proposes a method in which a feed electrode is provided, with a predetermined gap between the radiating electrode and the feed electrode, on one of the main surfaces of the dielectric block (on a surface where the radiating electrode is formed) According to this configuration, since it is not necessary to use the feed pin penetrating the dielectric block, surface mounting becomes easy, thereby enabling miniaturization and reduction in height of the radio equipment.

In the surface mounted antenna disclosed in Japanese Patent Application Laid-Open No. H11-74721, however, since the feed electrode is provided on one main surface of the dielectric block (on a surface where the radiating electrode is formed), the area of the main surface of the dielectric block increases as much as this portion, thereby causing a problem in that the mounting area increases. Further, when circularly polarized waves are to be radiated, with the surface mounted antenna disclosed in Japanese Patent Application Laid-Open No. H11-74721, since a conductor pattern for discharging right-hand polarized waves and a conductor pattern for discharging left-hand polarized waves are different from each other on one of the main surfaces of the dielectric block, it is necessary to form these conductor patterns (the radiating electrode and the feed electrode) on one of the main surfaces of the dielectric block by using different screen masks.

SUMMARY OF THE INVENTION

It is, therefore, an object of the present invention to provide a surface mounted antenna that can be further miniaturized and a radio equipment using the same.

It is another object of the present invention to provide a surface mounted antenna, in which a radiating electrode for right-hand polarized waves and a radiating electrode for left-hand polarized waves can be produced by using the same screen mask, and a radio equipment using the same.

The surface mounted antenna according to the present invention includes a dielectric block, a radiating electrode formed on one main surface thereof, a ground electrode formed on the other main surface of the dielectric block, and at least one feed electrode electromagnetically coupled to the radiating electrode formed on a surface different from the one main surface and the other main surface of the dielectric block.

According to the present invention, since the feed electrode is formed on a surface different from the one main surface and the other main surface of the dielectric block, the size of the one main surface of the dielectric block can be reduced as compared to the conventional dielectric block. Accordingly, since the surface mounted antenna can be further miniaturized, when the antenna is mounted on a printed circuit board or the like, the mounting area can be reduced as compared to the conventional case. Further, since adjustment of the resonance frequency and adjustment of the axial ratio and the impedance can be performed independently, the design can be made easy.

Further, if the electrode formed on the one main surface of the dielectric block is only the radiating electrode, the radiating electrode for right-hand polarized waves and the radiating electrode for left-hand polarized waves can be produced by using the same screen mask. According to this method, a surface mounted antenna for right-hand polarized waves and a surface mounted antenna for left-hand polarized waves can be produced separately, without substantially increasing the production cost.

The surface on which the feed electrode is formed is preferably a side surface substantially vertical to the one main surface and the other main surface of the dielectric block. According to this configuration, the feed electrode can be arranged without forming a through hole or the like in the dielectric block.

It is desired that the feed electrode is substantially in a T-shape. According to this feed electrode, adjustment of the axial ratio and the impedance is facilitated, and since the feed electrode is symmetric, the shortest wiring distance can be realized.

The feed electrode may include a first feed electrode formed on a first side surface of the dielectric block, and a second feed electrode formed on a second side surface of the dielectric block. In this case, if the radiating electrode has a planar shape capable of discharging circularly polarized waves, the right-hand polarized waves can be transmitted and received via the first feed electrode, and the left-hand polarized waves can be transmitted and received via the second feed electrode. In other words, the surface mounted antenna having the same configuration can be used both for the right-hand polarized waves and the left-hand polarized waves, without separately producing the surface mounted antenna for the right-hand polarized waves and the surface mounted antenna for the left-hand polarized waves. On the other hand, when the radiating electrode has a planar shape capable of radiating linearly polarized waves, the circularly polarized waves can be radiated by connecting a 90-degree phase shifter to one of the first and the second feed electrodes.

The radio equipment according to the present invention includes the surface mounted antenna, an RF unit connected to the radiating electrode of the surface mounted antenna, and a signal processor connected to the RF unit. Such a radio equipment can realize both miniaturization and reduction in production cost, since it uses an easily mountable surface mounted antenna having a small mounting area.

Thus, according to the present invention, the surface mounted antenna and the radio equipment using the same can be further miniaturized. Further, since the radiating electrode for right-hand polarized waves and the radiating electrode for left-hand polarized waves can be produced by using the same screen mask, production cost can be also reduced.

DETAILED DESCRIPTION OF THE EMBODIMENTS

Preferred embodiments of the present invention will now be explained in detail with reference to the drawings.

Figure 1A:
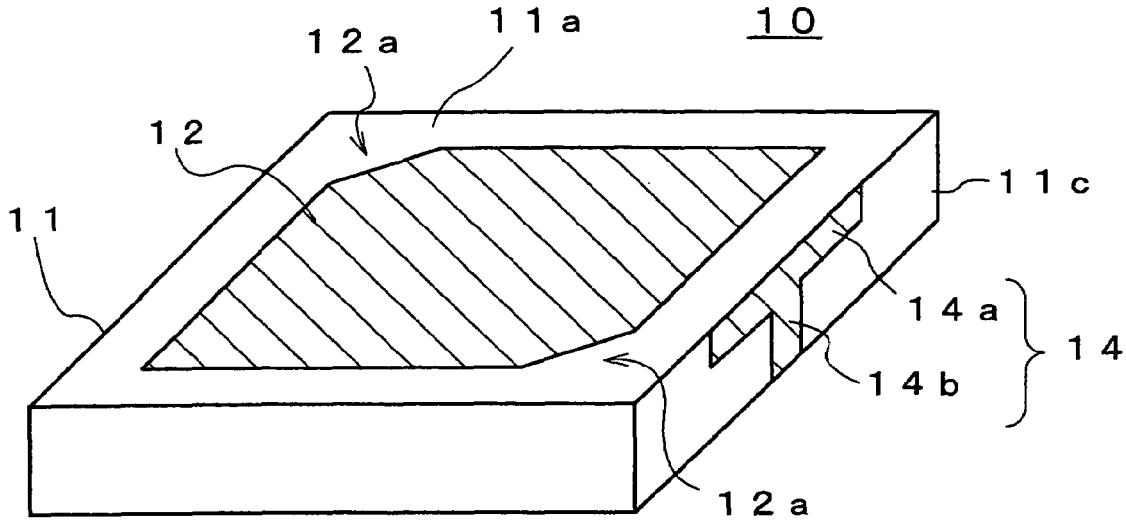
FIGS. 1A and 1B are schematic perspective views of the configuration of a surface mounted antenna 10 according to a preferred embodiment of the present invention, FIG. 1A being a diagram as seen from the upper diagonal direction and FIG. 1B being a diagram as seen from the lower diagonal direction.
Figure 1B:
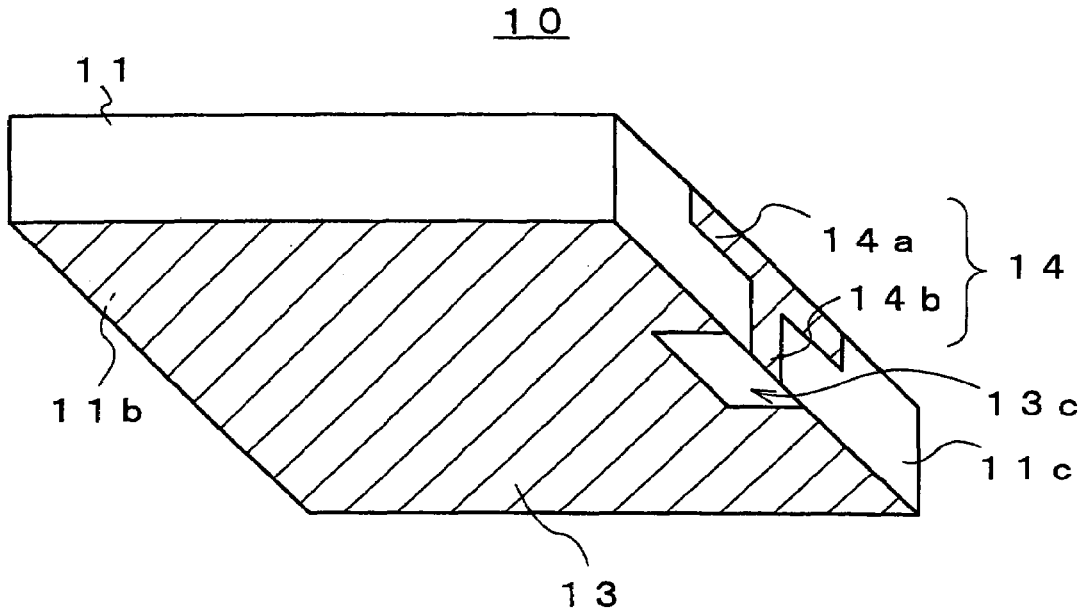

FIGS. 1A and 1B are schematic perspective views of the configuration of a surface mounted antenna 10 according to a preferred embodiment of the present invention, FIG. 1A being a diagram as seen from the upper diagonal direction and FIG. 1B being a diagram as seen from the lower diagonal direction.

As shown in FIGS. 1A and 1B, a surface mounted antenna 10 according to a first embodiment includes a dielectric block 11 in a cuboid plate shape, a radiating electrode 12 formed on one main surface 11*a* of the dielectric block 11, a ground electrode 13 formed on the other main surface 11*b* of the dielectric block 11, and a feed electrode 14 formed on a side surface 11*c* of the dielectric block 11.

The material used for the dielectric block 11 may be appropriately selected according to the desired frequency. To miniaturize the dielectric block 11 while ensuring a sufficient gain, however, for example, it is preferable to form the dielectric block 11 by using a material having a relative permittivity $\in r$ of about 20 to 25. The material having a relative permittivity $\in r$ of about 20 to 25 includes Mg—Ca—Ti dielectric ceramic. As the Mg—Ca—Ti dielectric ceramic, it is particularly preferable to use Mg—Ca—Ti dielectric ceramic containing $TiO_2$, MgO, CaO, MnO, and $SiO_2$.

The radiating electrode 12 is formed on one main surface 11*a* of the dielectric block 11, and the planer shape thereof is substantially square excluding a notch 12*a* at two corners. The notch 12*a* is provided for generating circularly polarized waves. In the first embodiment, the notch 12*a* is provided at the right corner on the other side and at the left corner on this side as seen from the feed electrode 14. Accordingly, the radiating electrode 12 can radiate right-hand polarized waves.

The ground electrode 13 is formed on substantially the entire surface of the other main surface 11*b* of the dielectric block 11 excluding the notch 13*a* provided near the end of the feed electrode 14. The notch 13*a* is provided for preventing short circuit of the feed electrode 14 and the ground electrode 13. At the time of actually mounting the dielectric block 11 to a printed circuit board or the like, the side where the ground electrode 13 is provided is mounted so as to face the printed circuit board or the like.

The planar shape of the feed electrode 14 is a substantially T shape as shown in FIGS. 1A and 1B. A lateral bar portion 14a of the T shape is arranged at a portion adjacent to the main surface 11*a* of the dielectric block 11 so as to be opposite to one side of the radiating electrode 12, and a longitudinal bar portion 14*b* of the T shape is arranged to extend from the center in the longitudinal direction of the lateral bar portion 14*a* to a portion adjacent to the other main surface 11*b* of the dielectric block 11. The feed electrode 14 does not come in direct contact with the radiating electrode 12, however, the feed electrode 14 can feed power to the radiating electrode 12 by electromagnetic coupling.

The material used for the radiating electrode 12, the ground electrode 13, and the feed electrode 14 is not particularly limited, however, a paste including, for example, gold (Au), silver (Ag), copper (Cu), palladium (Pd), platinum (Pt), aluminum (Al), or the alloys thereof (silver/palladium, silver/platinum, and the like) can be used. It is preferable to form these electrodes by using screen printing.

The configuration of the surface mounted antenna 10 according to the first embodiment has been explained above. In the surface mounted antenna 10 according to the first embodiment, only the radiating electrode 12 is formed on the main surface 11*a* of the dielectric block 11, and the feed electrode 14 is formed on the side surface 11*c* of the dielectric block 11. Therefore, the size of the main surface 11*a* of the dielectric block 11 can be made smaller than the conventional size, thereby realizing further miniaturization. Accordingly, when the dielectric block is mounted on a printed circuit board or the like, the mounting area can be reduced as compared with the conventional case.

Figure 2:
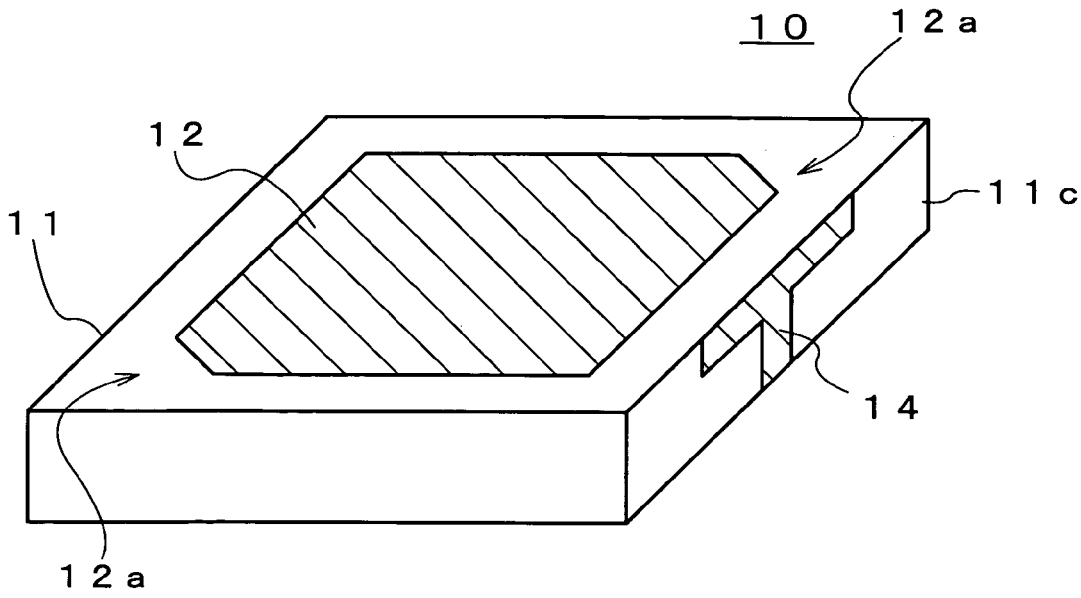
FIG. 2 is a schematic perspective view of the configuration of the surface mounted antenna 10 that radiates left-hand polarized waves.

Since only the radiating electrode 12 is formed on the main surface 11*a* of the dielectric block 11, the shape of the radiating electrode 12 can be easily changed. That is, in the surface mounted antenna 10 shown in FIGS. 1A and 1B, the notches 12*a* are provided at the right corner on the other side and at the left corner on this side as seen from the feed electrode 14, so that right-hand polarized waves can be radiated. However, as shown in FIG. 2, if the notches 12*a* are provided at the left corner on the other side and at the right corner on this side as seen from the feed electrode 14, left-hand polarized waves can be radiated. In this case, the same screen mask for the right-hand polarized waves can be used, and it is only necessary to change the direction thereof. Accordingly, the surface mounted antenna for right-hand polarized waves and the surface mounted antenna for left-hand polarized waves can be produced, without substantially increasing the production cost.

Figure 3:
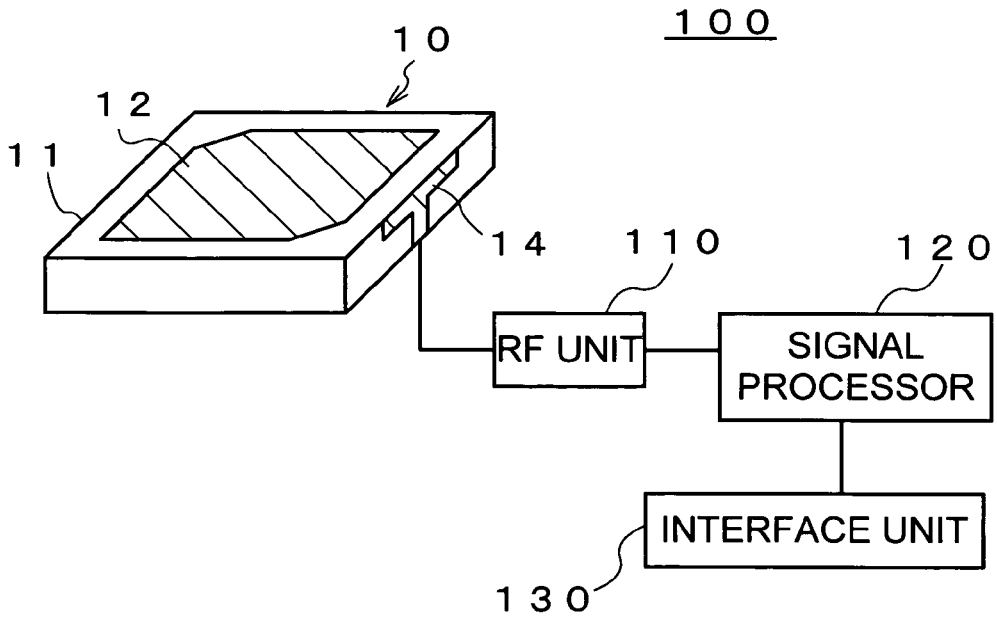
FIG. 3 is a schematic diagram of the configuration of a radio equipment 100 using the surface mounted antenna 10.

FIG. 3 is a schematic diagram of the configuration of a radio equipment 100 using the surface mounted antenna 10.

As shown in FIG. 3, the radio equipment 100 includes an RF unit 110 connected to the feed electrode 14, a signal processor 120 connected to the RF unit 110, and an interface unit 130 connected to the signal processor 120. Therefore, a signal received by the surface mounted antenna 10 is converted to a processable format by the RF unit 110, processed by the signal processor 120, and output from the interface unit 130. Likewise, the signal input from the interface unit 130 is processed by the signal processor 120, converted to a high-frequency signal by the RF unit 110, and discharged by the surface mounted antenna 10. The interface unit 130 includes an output device such as a speaker, a display, and a printer, or an input device such as a microphone, a keyboard, and a mouse. A storage device (not shown) such as a hard disk device and a CD-ROM drive can be further connected to the signal processor 120.

Since such a radio equipment 100 uses the surface mounted antenna 10, which has a small mounting area and can be easily mounted, various radio equipment utilizing circular polarized waves, for example, a global positioning system (GPS), an electronic toll collection (ETC) system, and satellite radio can be produced in a small size and at a low production cost.

Figure 4:
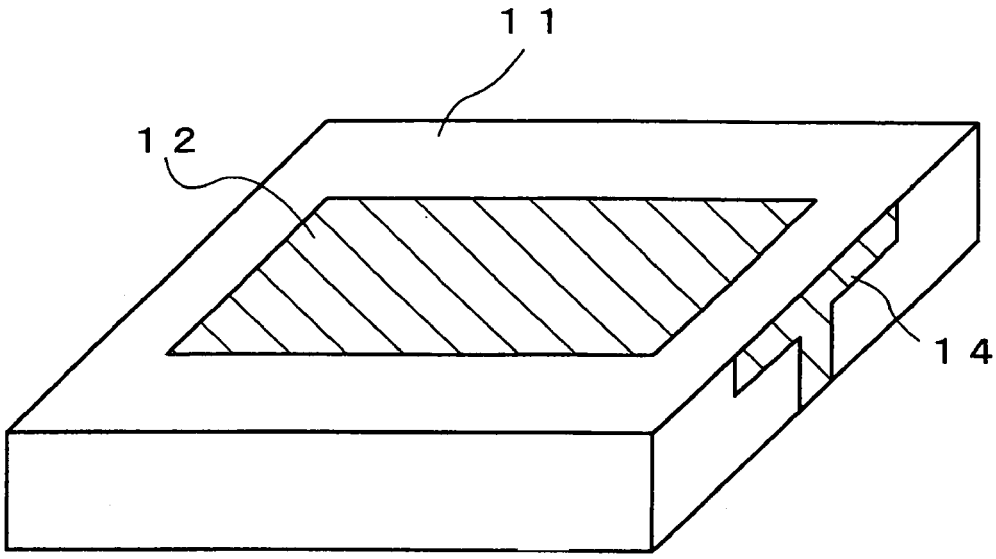
FIG. 4 depicts an example in which the planer shape of a radiating electrode 12 is rectangular without having a notch or a protrusion.
Figure 5:
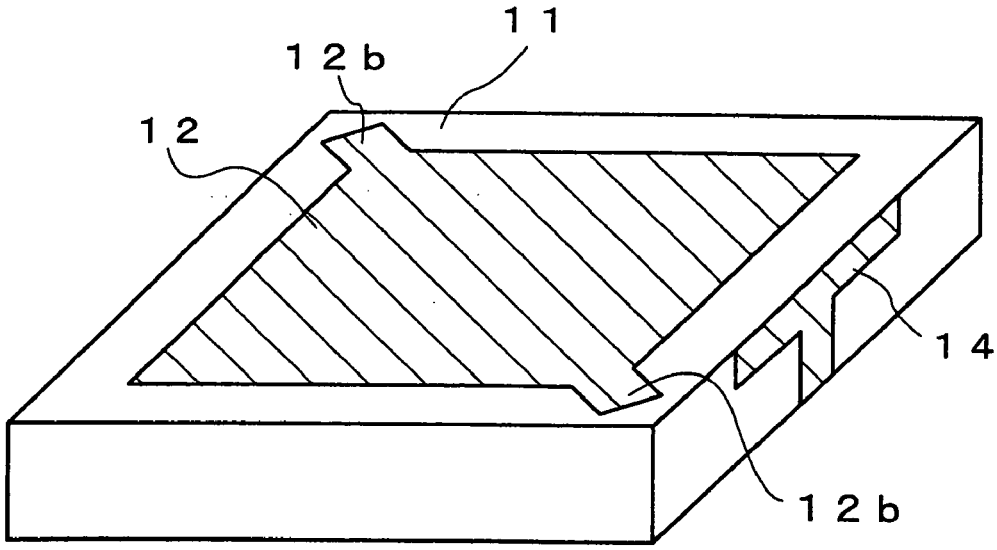
FIG. 5 is an example in which the planer shape of the radiating electrode 12 is square having a protrusion at two corners.
Figure 6:
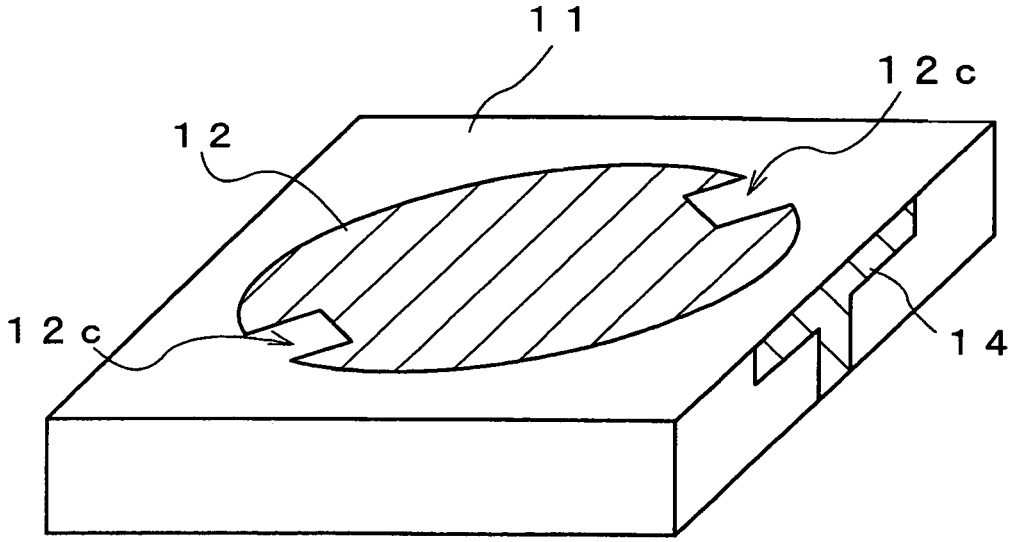
FIG. 6 is an example in which the planer shape of the radiating electrode 12 is circular having a notch at opposite positions.
Figure 7:
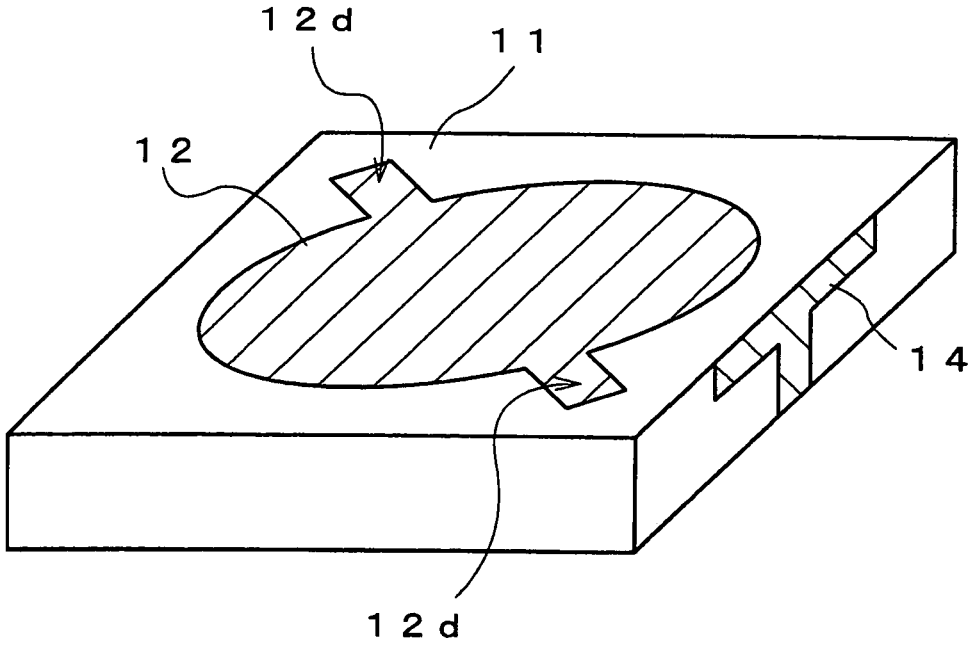
FIG. 7 is an example in which the planer shape of the radiating electrode 12 is circular having a protrusion at opposite positions.
Figure 8:
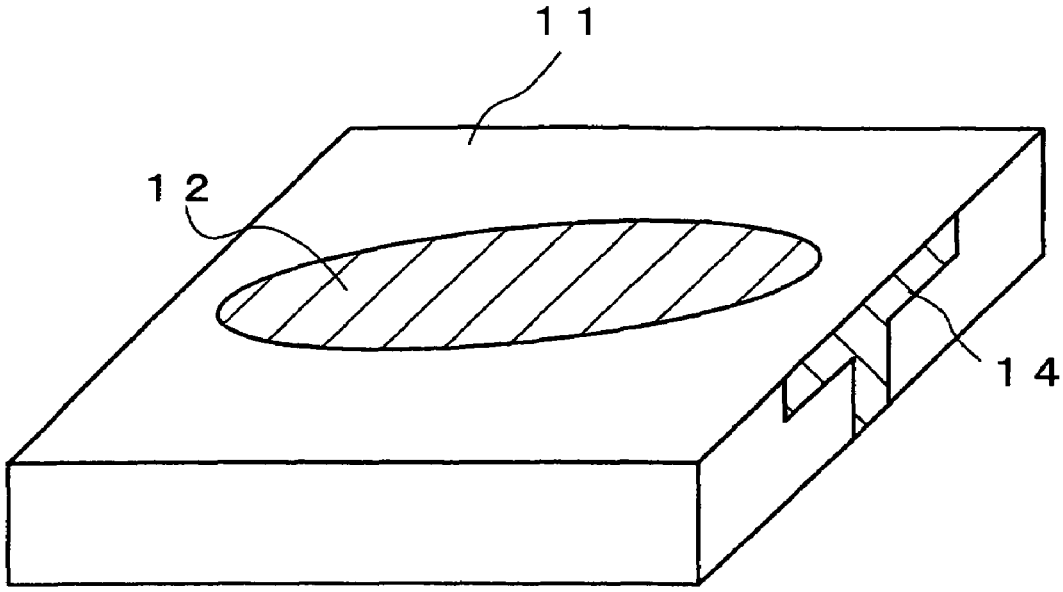
FIG. 8 is an example in which the planer shape of the radiating electrode 12 is elliptic without having a notch or a protrusion.

In the surface mounted antenna 10 according to the first embodiment, the planer shape of the radiating electrode 12 is substantially square, excluding the notches 12*a* at the corner. However, various other shapes can be used for the radiating electrode 12 for radiating the circularly polarized waves. For example, the planer shape of the radiating electrode 12 may be rectangular without having a notch or protrusion as shown in FIG. 4, square with protrusions 12*b* at opposite corners as shown in FIG. 5, circular with notches 12*c* at opposite positions as shown in FIG. 6, circular with protrusions 12*d* at opposite positions as shown in FIG. 7, or elliptic without having a notch or a protrusion as shown in FIG. 8.

Examples shown in FIGS. 4 to 8 are for radiating right-hand polarized waves, however, if these radiating electrodes 12 are rotated by 90°, left-hand polarized waves can be radiated. In this case also, the same screen mask is used, and it is only necessary to change the direction.

Figure 9:
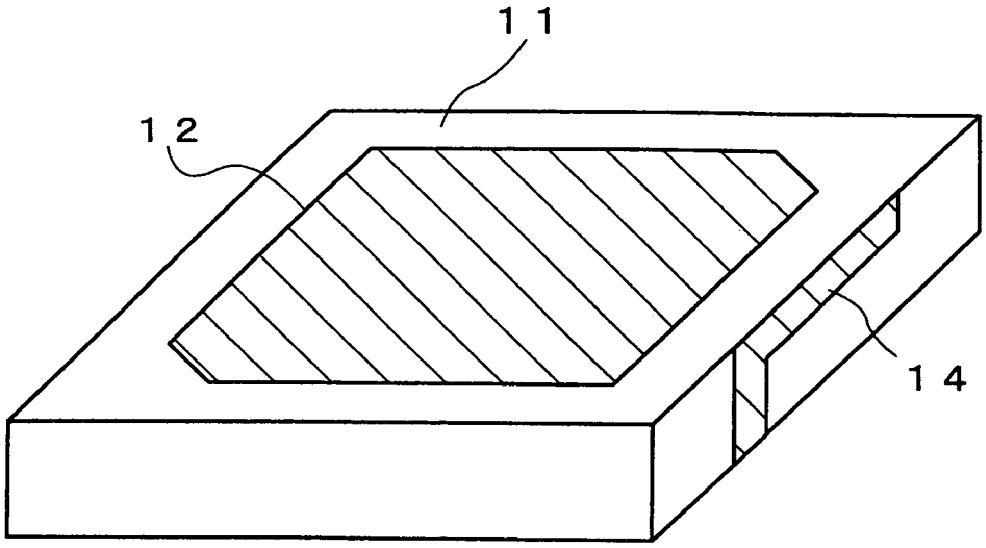
FIG. 9 is an example in which the planer shape of a feed electrode 14 is substantially in an L shape.
Figure 10:
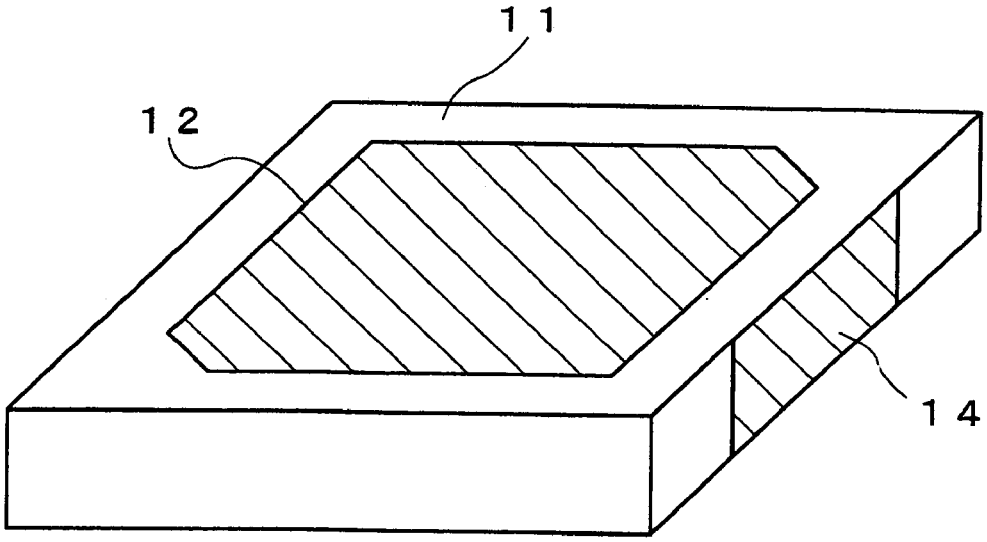
FIG. 10 is an example in which the planer shape of the feed electrode 14 is linear (rectangular) with a certain width.
Figure 11:
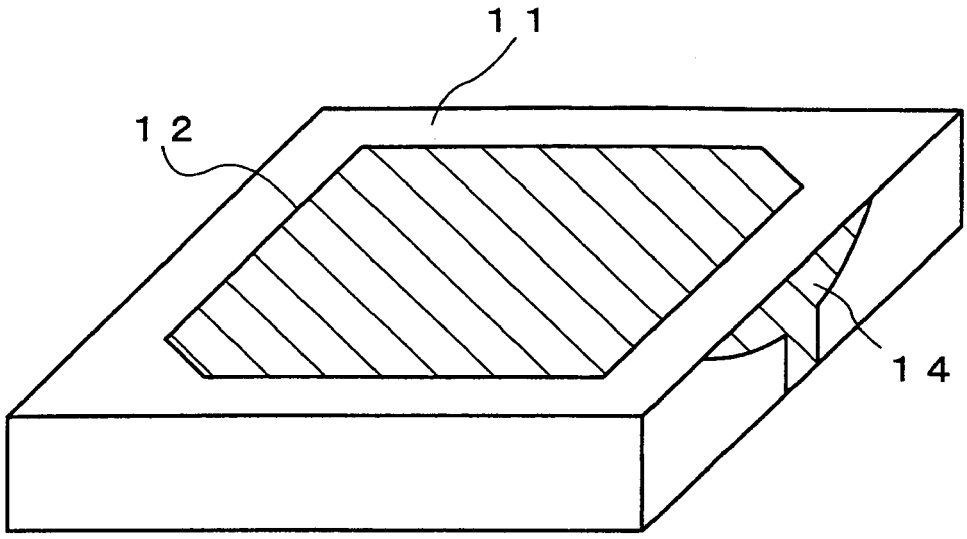
FIG. 11 is an example in which the planer shape of the feed electrode 14 is a shape including a semicircle.
Figure 12:
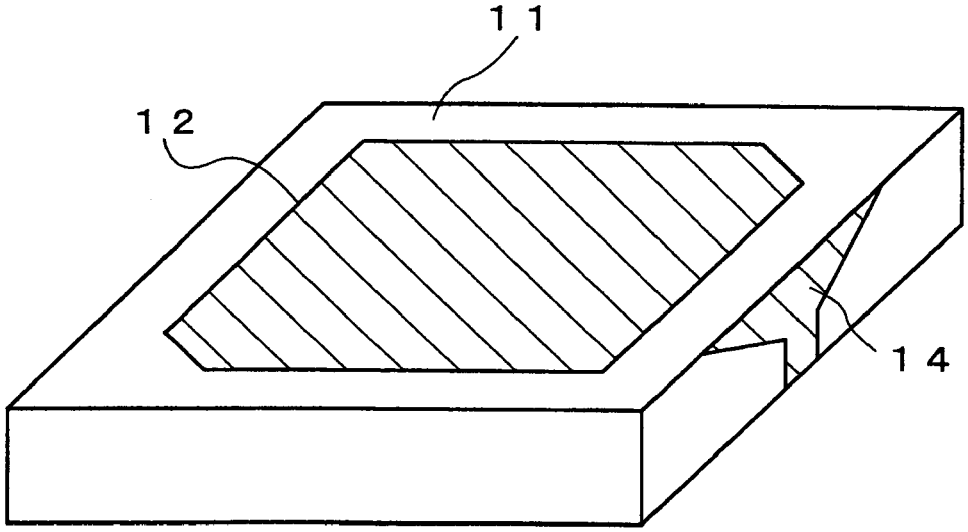
FIG. 12 is an example in which the planer shape of the feed electrode 14 is a shape including a triangle.

In the surface mounted antenna 10 according to the first embodiment, the planer shape of the feed electrode 14 is substantially T shape, but the planer shape may be appropriately changed, taking the axial ratio or impedance into consideration. For example, the planer shape of the feed electrode 14 may be substantially L shape as shown in FIG. 9 or linear (rectangular) with a certain width as shown in FIG. 10. Alternatively, the lateral bar portion 14*a* (see FIGS. 1A and 1B) of the T shape may be replaced with a semi circle as shown in FIG. 11, or may be replaced with a triangle as shown in FIG. 12. In other words, since the axial ratio and the impedance are substantially determined by the length of the side adjacent to the main surface 11*a* of the dielectric block 11, of the sides of the feed electrode 14, the feed electrode 14 may have any shape, as long as the side is linear and is arranged so as to be adjacent to the main surface 11*a* of the dielectric block 11. However, it is most preferable to make the planar shape of the feed electrode 14 substantially T shape as shown in FIGS. 1A and 1B, taking into consideration that the adjustment of the axial ratio and the impedance is easy, and the wiring distance can be made shortest by having a symmetrical shape.

Figure 13A:
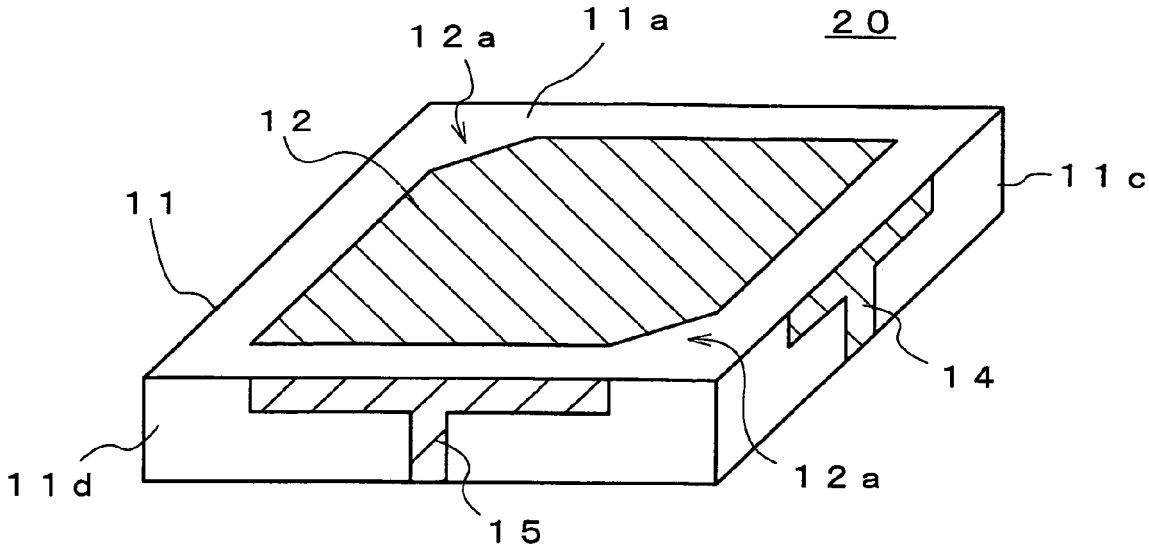
FIGS. 13A and 13B are schematic perspective views of the configuration of a surface mounted antenna 20 according to another embodiment of the present invention, FIG. 13A being a diagram as seen from the upper diagonal direction and FIG. 13B being a diagram as seen from the lower diagonal direction.
Figure 13B:
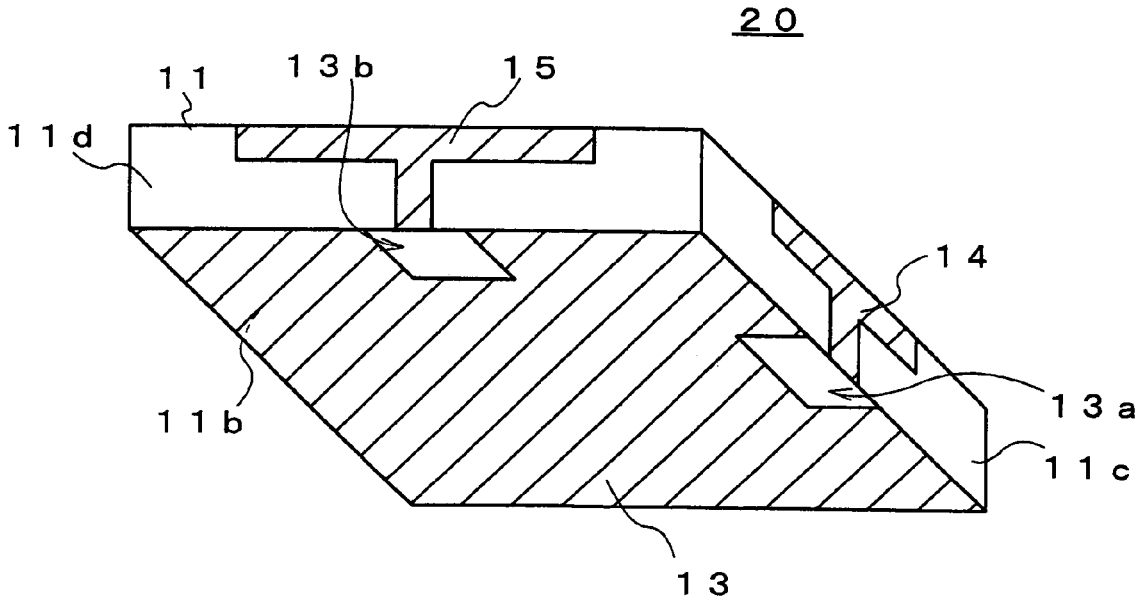

FIGS. 13A and 13B are schematic perspective views of the configuration of a surface mounted antenna 20 according to another embodiment of the present invention, FIG. 13A being a diagram as seen from the upper diagonal direction and FIG. 13B being a diagram as seen from the lower diagonal direction.

As shown in FIGS. 13A and 13B, a surface mounted antenna 20 according to a second embodiment is different from the surface mounted antenna 10 in that the surface mounted antenna 20 further includes a feed electrode 15 formed on a side surface lid of the dielectric block 11, and a notch 13*b* is further provided in the ground electrode 13 near the feed electrode 15. Since other points are the same as the surface mounted antenna 10 according to the first embodiment, like reference signs refer to like parts and a redundant explanation is omitted.

The side surface 11*c* (first side surface) on which the feed electrode 14 (first feed electrode) is provided and the side surface 11*d* (second side surface) on which the feed electrode 15 (second feed electrode) is provided are adjacent to each other, and hence, these side surfaces form an angle of 90°. Therefore, the surface mounted antenna 20 according to the second embodiment can transmit and receive right-hand polarized waves via the feed electrode 14, and left-hand polarized waves via the feed electrode 15. That is, according to the second embodiment, the surface mounted antenna having the same configuration can be used for the right-hand polarized waves and for the left-hand polarized waves, without producing the surface mounted antenna for right-hand polarized waves and the surface mounted antenna for left-hand polarized waves separately. Accordingly, cost can be further reduced.

Figure 14:
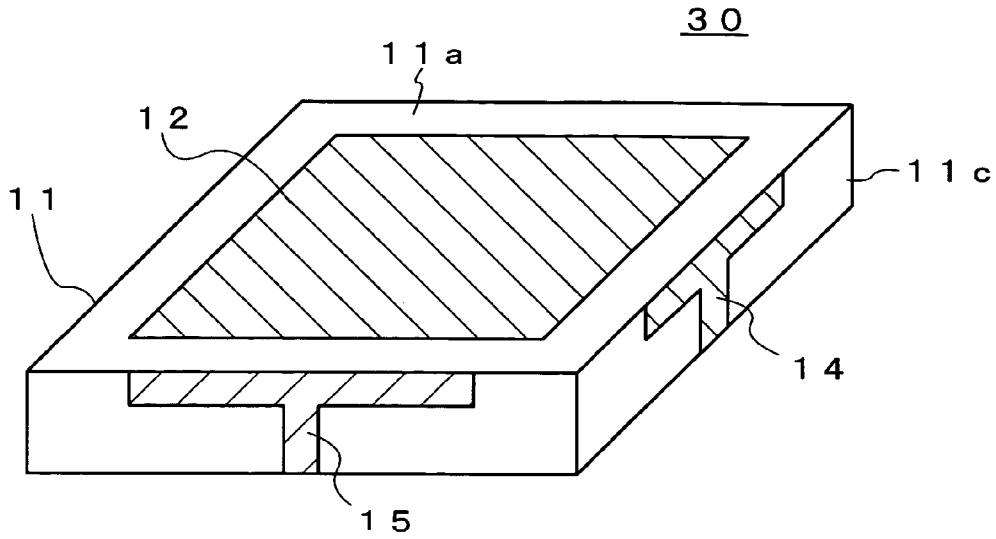
FIG. 14 is a schematic perspective view of the configuration of a surface mounted antenna 30 according to still another embodiment of the present invention.

FIG. 14 is a schematic perspective view of the configuration of a surface mounted antenna 30 according to still another embodiment of the present invention.

As shown in FIG. 14, a surface mounted antenna 30 according to a third embodiment is different from the surface mounted antenna 20 according to the second embodiment in that the planer shape of the radiating electrode 12 is square and the notches are not provided. Since the other points are the same as the surface mounted antenna 20 according to the second embodiment, like reference signs refer to like parts and a redundant explanation is omitted. Though not shown, the state of the surface mounted antenna 30 according to the third embodiment as seen from the lower diagonal direction is the same as that shown in FIG. 13B.

Figure 15:
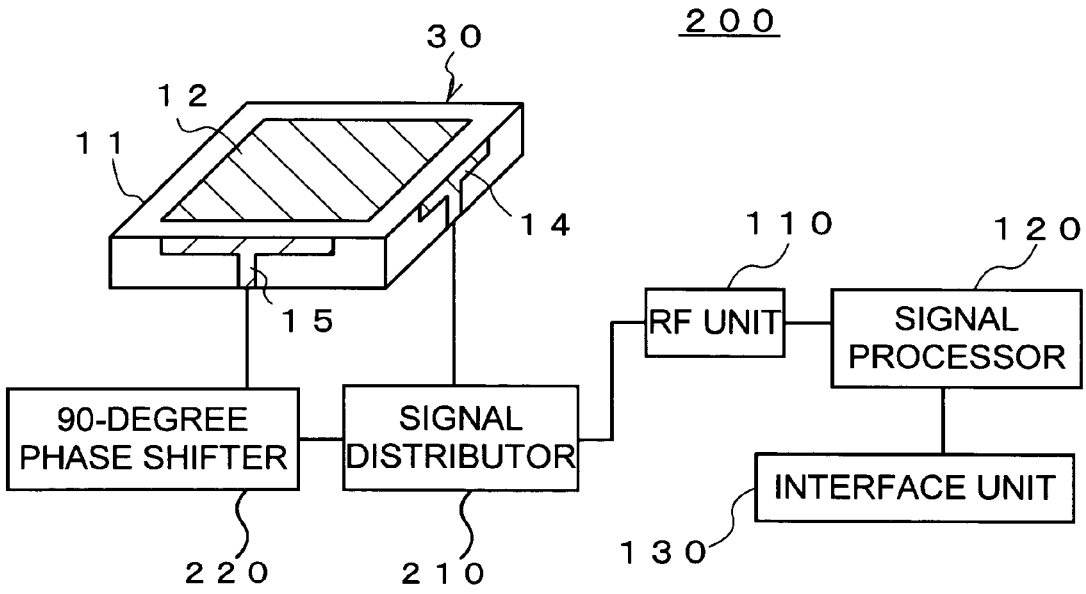
FIG. 15 is a schematic diagram of the configuration of a radio equipment 200 using the surface mounted antenna 30.

FIG. 15 is a schematic diagram of the configuration of a radio equipment 200 using the surface mounted antenna 30.

As shown in FIG. 15, a radio equipment 200 is different from the radio equipment 100 shown in FIG. 3 in that a signal distributor 210 is provided between the feed electrodes 14 and 15 and the RF unit 110 and a 90-degree phase shifter 220 is provided between the signal distributor 210 and the feed electrode 15. Therefore, the signal from the RF unit 110 is divided into two by the signal distributor 210 and supplied directly to the feed electrode 14, and to the feed electrode 15 by shifting the phase by 90° by the 90-degree phase shifter 220. Accordingly, resonance occurs in the radiating electrode 12 in two directions orthogonal to each other, thereby enabling radiation of circularly polarized waves.

While preferred embodiments of the present invention have been explained, the invention is not limited by the embodiments. Various modifications can be made without departing from the sprit of the invention, and those modifications are also embraced within the scope of the invention.

For example, in the above embodiments, surface mounted antennas radiating circularly polarized waves have been explained. However, the present invention is not limited thereto, and is also applicable to a surface mounted antenna of a type radiating linearly polarized waves. In this case, various radio equipment using the linearly polarized waves, for example, radio equipment for the wireless local area network (LAN), the Bluetooth equipment, and the like can be produced in a small size and at a low cost.

Figure 16:
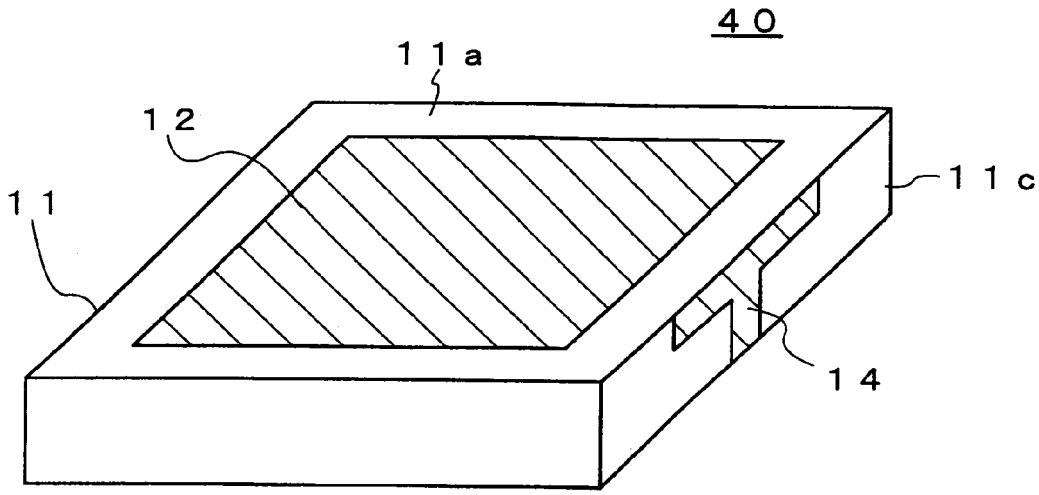
FIG. 16 is a schematic perspective view of the configuration of a surface mounted antenna 40 that radiates linear polarized waves.

FIG. 16 is a schematic perspective view of the configuration of a surface mounted antenna 40 that radiates linear polarized waves. As shown in FIG. 16, a surface mounted antenna 40 according to a fourth embodiment is different from the surface mounted antenna 10 according to the first embodiment (see FIGS. 1A and 1B) in that the planer shape of the radiating electrode 12 is square and the notches are not provided. According to this configuration, linearly polarized waves can be radiated, different from the above respective embodiments.

Figure 17:
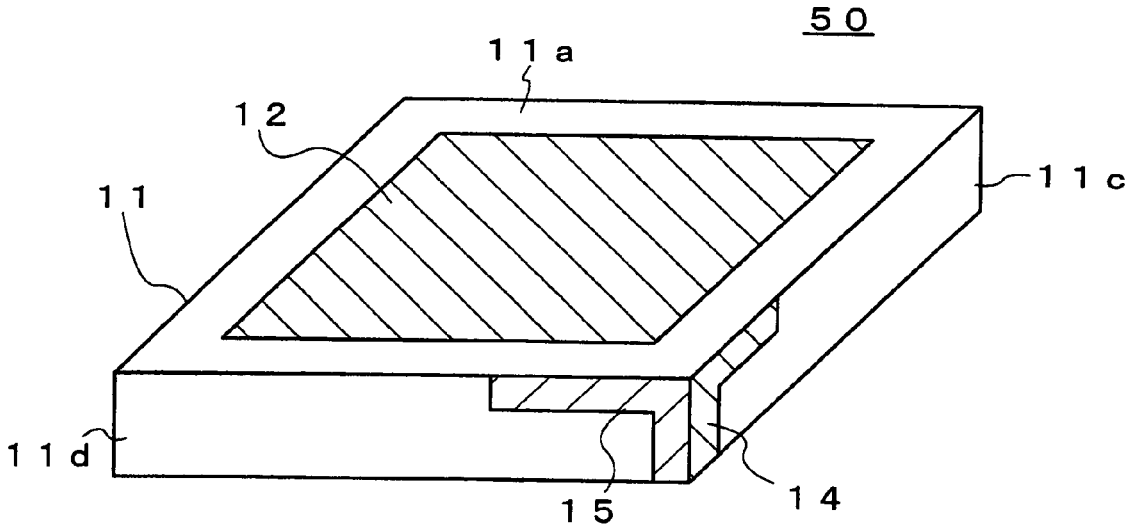
FIG. 17 is a schematic perspective view of the configuration of a surface mounted antenna 50 that radiates linear polarized waves.

FIG. 17 is a schematic perspective view of the configuration of a surface mounted antenna 50, that radiates linear polarized waves. As shown in FIG. 17, a surface mounted antenna 50 according to a fifth embodiment is different from the surface mounted antenna 40 (see FIG. 16) in that the side surfaces 11*c* and 11*d* of the dielectric block 11 adjacent to each other respectively include substantially L-shape feed electrodes 14 and 15, so that the feed electrodes 14 and 15 are integrated at the corner to form together a T shape as a whole. Also in this configuration, linearly polarized waves can be radiated.

In the respective embodiments, the dielectric block 11 has a cuboid shape, but the dielectric block 11 may have other shapes such as a columnar shape. In this case, if the feed electrode is formed on a surface different from the main surfaces of the dielectric block, the same effects as those of the above embodiments can be obtained.

Figure 18:
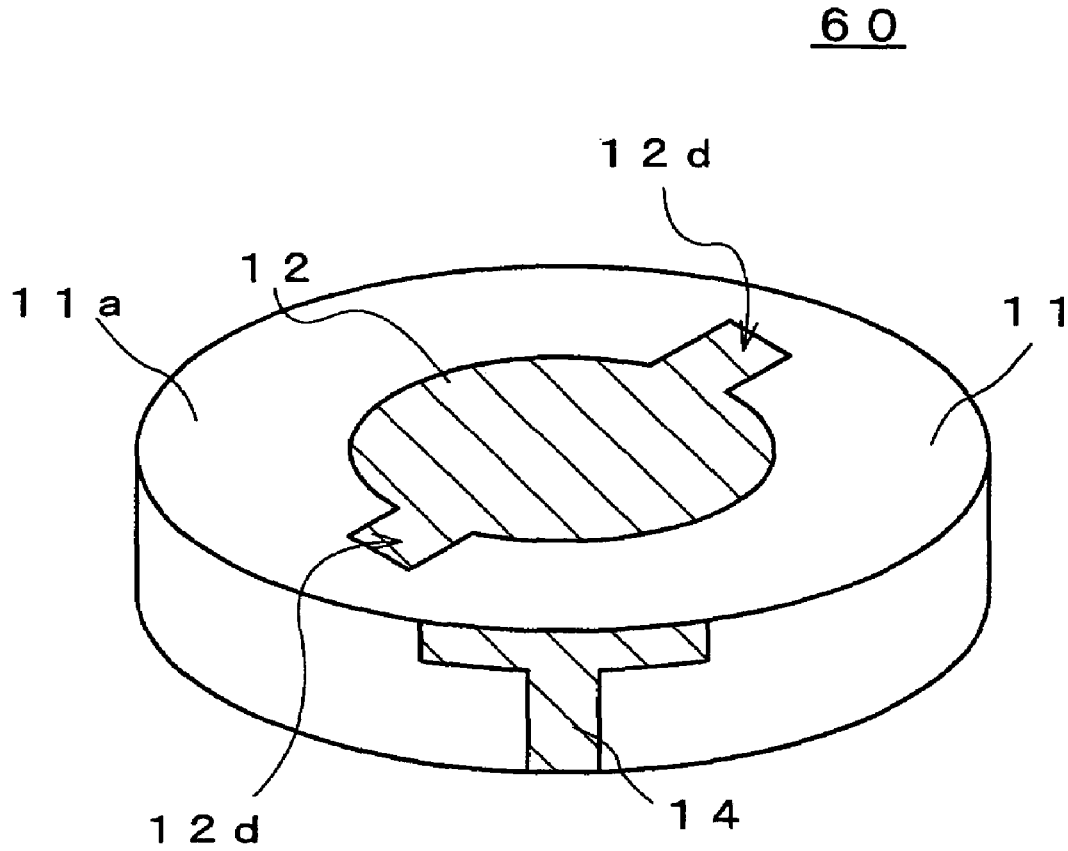
FIG. 18 is a schematic perspective view of the configuration of a surface mounted antenna 60 having a columnar dielectric block 11.

FIG. 18 is a schematic perspective view of the configuration of a surface mounted antenna 60 having a columnar dielectric block 11. As shown in FIG. 18, in a surface mounted antenna 60 according to a sixth embodiment, a circular radiating electrode 12 is provided on the main surface 11*a* of a columnar dielectric block 11, and protrusions 12*d* are provided at opposite positions of the radiating electrode 12. The feed electrode 14 has a substantially T shape. In this configuration also, right-hand polarized waves can be radiated.

What is claimed is:

1. A surface mounted antenna comprising a dielectric block, a radiating electrode formed on a one main surface of the dielectric block, a ground electrode formed on the other main surface of the dielectric block, and at least one feed electrode electromagnetically coupled to the radiating electrode formed on a surface different from the one main surface and the other main surface of the dielectric block, wherein the feed electrode has a linear end facing to the radiating electrode, the linear end substantially parallel to and substantially ending at an edge of the one main surface.

2. The surface mounted antenna as claimed in claim 1, wherein said surface different from the one main surface and the other main surface is a side surface substantially vertical to the one main surface and the other main surface of the dielectric block.

3. The surface mounted antenna as claimed in claim 1, wherein said feed electrode is substantially in a T-shape.

4. The surface mounted antenna as claimed in claim 2, wherein said feed electrode is substantially in a T-shape.

5. The surface mounted antenna as claimed in claim 1, wherein said feed electrode include a first feed electrode formed on a first side surface of the dielectric block and a second feed electrode formed on a second side surface of the dielectric block.

6. The surface mounted antenna as claimed in claim 2, wherein said feed electrode include a first feed electrode formed on a first side surface of the dielectric block and a second feed electrode formed on a second side surface of the dielectric block.

7. The surface mounted antenna as claimed in claim 3, wherein said feed electrode include a first feed electrode formed on a first side surface of the dielectric block and a second feed electrode formed on a second side surface of the dielectric block.

8. The surface mounted antenna as claimed in claim 1, wherein said radiating electrode has a planar shape capable of radiating circularly polarized waves.

9. The surface mounted antenna as claimed in claim 2, wherein said radiating electrode has a planar shape capable of radiating circularly polarized waves.

10. The surface mounted antenna as claimed in claim 3, wherein said radiating electrode has a planar shape capable of radiating circularly polarized waves.

11. The surface mounted antenna as claimed in claim 5, wherein said radiating electrode has a planar shape capable of radiating circularly polarized waves.

12. The surface mounted antenna as claimed in claim 1, wherein the only electrode formed on said one main surface of the dielectric block is the radiating electrode.

13. The surface mounted antenna as claimed in claim 2, wherein the only electrode formed on said one main surface of the dielectric block is the radiating electrode.

14. The surface mounted antenna as claimed in claim 3, wherein the only electrode formed on said one main surface of the dielectric block is the radiating electrode.

15. The surface mounted antenna as claimed in claim 5, wherein the only electrode formed on said one main surface of the dielectric block is the radiating electrode.

16. The surface mounted antenna as claimed in claim 8, wherein the only electrode formed on said one main surface of the dielectric block is the radiating electrode.

17. A radio equipment, comprising:

a surface mounted antenna comprising a dielectric block, a radiating electrode formed on a one main surface of the dielectric block, a ground electrode formed on the other main surface of the dielectric block, and at least one feed electrode electromagnetically coupled to the radiating electrode formed on a surface different from the one main surface and the other main surface of the dielectric block, wherein the feed electrode has a linear end facing to the radiating electrode, the linear end substantially parallel with and abutting an edge of the one main surface;

an RF unit connected to the radiating electrode of the surface mounted antenna; and a signal processor connected to the RF unit.

18. The radio equipment as claimed in claim 17, wherein said surface different from the one main surface and the other main surface is a side surface substantially vertical to the one main surface and the other main surface of the dielectric block.

19. The radio equipment as claimed in claim 17, wherein said feed electrode is substantially in a T-shape.

20. The radio equipment as claimed in claim 17, wherein said feed electrode include a first feed electrode formed on a first side surface of the dielectric block and a second feed electrode formed on a second side surface of the dielectric block.

21. An apparatus, comprising:

a surface mounted antenna including a dielectric block, a radiating electrode formed on a first surface of the dielectric block, a ground electrode formed on a second surface of the dielectric block, a first feed electrode electromagnetically coupled to the radiating electrode and formed on a third surface that is different from the first surface and the second surface of the dielectric block, and a second feed electrode electromagnetically coupled to the radiating electrode and formed on a forth surface that is different from the first surface, the second surface, and the third surface of the dielectric block.

22. The apparatus as claimed in claim 21, wherein said radiating electrode has a planar shape capable of radiating circularly polarized waves.

23. The apparatus as claimed in claim 21, wherein the only electrode formed on the first surface of the dielectric block is the radiating electrode.

24. The apparatus as claimed in claim 21, further comprising:

an RF unit connected to the radiating electrode of the surface mounted antenna; and a signal processor connected to the RF unit, wherein the first surface and second surface are main surfaces that are larger in size than the third surface and fourth surface, and wherein the radiating electrode is formed only on the first surface, the ground electrode is formed only on the second surface, the only electrode formed on the third surface of the dielectric block is the first feed electrode and the only electrode formed on the fourth surface of the dielectric block is the second feed electrode, the first feed electrode and the second feed electrode are not physically connected to one another.

25. An apparatus, comprising:

a surface mounted antenna including a dielectric block, a radiating electrode formed on a first surface of the dielectric block, a ground electrode formed on a second surface of the dielectric block, and a feed electrode coupled to the radiating electrode only electromagnetically and formed on a third surface that is different from the first surface and the second surface of the dielectric block, wherein the radiating electrode is formed only on the first surface, the ground electrode is formed only on the second surface, and the feed electrode is formed only on the third surface of the dielectric block.

* * * * *